US006672971B2

(12) United States Patent
Barlow

(10) Patent No.: US 6,672,971 B2
(45) Date of Patent: Jan. 6, 2004

(54) PORTABLE GOLF PUTTING TRAINING AID

(76) Inventor: David R. Barlow, 7620 Harborview Way N., Seminole, FL (US) 33776

( * ) Notice: Subject to any disclaimer, the term of this patent is extended or adjusted under 35 U.S.C. 154(b) by 0 days.

(21) Appl. No.: 10/047,599

(22) Filed: Jan. 14, 2002

(65) Prior Publication Data

US 2003/0134684 A1 Jul. 17, 2003

(51) Int. Cl.[7] ..... A63B 69/36
(52) U.S. Cl. ..... 473/162
(58) Field of Search ..... 473/157–164

(56) References Cited

U.S. PATENT DOCUMENTS

| | | | | | |
|---|---|---|---|---|---|
| 1,914,365 | A | | 6/1933 | Ford | |
| 2,515,847 | A | * | 7/1950 | Winkler | 428/17 |
| 3,661,687 | A | | 5/1972 | Spinney, Jr. et al. | |
| 3,669,454 | A | | 6/1972 | Kolonel | |
| 3,715,123 | A | | 2/1973 | Baum | |
| 3,727,918 | A | | 4/1973 | Zawacki | |
| 3,735,988 | A | * | 5/1973 | Palmer et al. | 473/162 |
| 3,743,295 | A | * | 7/1973 | Flowers | 473/171 |
| 3,871,650 | A | | 3/1975 | Casey | |
| 4,202,547 | A | | 5/1980 | Mueller | |
| 4,211,417 | A | * | 7/1980 | Brown | 473/160 |
| 4,244,576 | A | * | 1/1981 | Mosier et al. | 473/159 |
| 5,007,644 | A | | 4/1991 | Bluthardt et al. | |
| 5,042,813 | A | * | 8/1991 | Huang | 473/153 |
| 5,366,224 | A | * | 11/1994 | Stanwyck et al. | 473/162 |
| 5,916,034 | A | | 6/1999 | Lancia | |
| 6,302,803 | B1 | * | 10/2001 | Barlow | 473/162 |
| 6,338,682 | B1 | | 1/2002 | Torchia et al. | |
| 6,413,166 | B1 | * | 7/2002 | Long | 473/160 |
| 6,428,420 | B1 | * | 8/2002 | Durnell | 473/162 |

FOREIGN PATENT DOCUMENTS

| | | | |
|---|---|---|---|
| EP | 0160952 | * | 5/1984 |

* cited by examiner

*Primary Examiner*—Mark S. Graham
(74) *Attorney, Agent, or Firm*—Larson & Larson, PA; James E. Larson

(57) ABSTRACT

Multiple molded polymeric units are joined together by side mounted fastening mechanisms. Each polymeric unit is molded as an integral structure with a smooth contoured top surface and a bottom grid like portion. Each polymeric unit has two side walls containing slots for mounting the fastening mechanism. A third side wall joining the two walls is a raised rolled edge higher than the top surface. The polymeric unit has a receptacle for receipt of a golf cup and a water drain hole. A simulated grass layer overlays the smooth top surface of the joined polymeric units.

21 Claims, 9 Drawing Sheets

PORTABLE GOLF PUTTING TRAINING AID

FIELD OF THE INVENTION

This invention relates to practice golf putting greens. More particularly, it refers to a portable sectional golf putting green wherein sections are held together by locking features.

BACKGROUND OF THE INVENTION

The expanding interest in golf has created a demand for golf practice tools, particularly putting greens. The ability to putt accurately distinguishes the ordinary golfer from the skilled golfer. With an interest in improving golf putting skills, the portable golf putting green of U.S. Pat. No. 6,302,803 was developed. Although the portable golf putting green described in this patent has been commercially accepted and serves its intended purpose, a need exists for variations that suit particular markets.

SUMMARY OF THE INVENTION

The invention of this application is a molded one piece polymeric unit attachable by locking features to adjacent one piece polymeric units which are then covered by a simulated grass layer to create a putting surface simulating a putting green. The one piece polymeric units are prepared by compression, blow or injection molding to prepare a smooth top surface integral with a bottom grid structure. Locking features are mounted into slots in side surfaces juxtaposed to an adjacent polymeric unit while an edge distal from any adjacent polymeric unit has a raised rolled edge. Golf ball receiving holes also are molded into the units.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
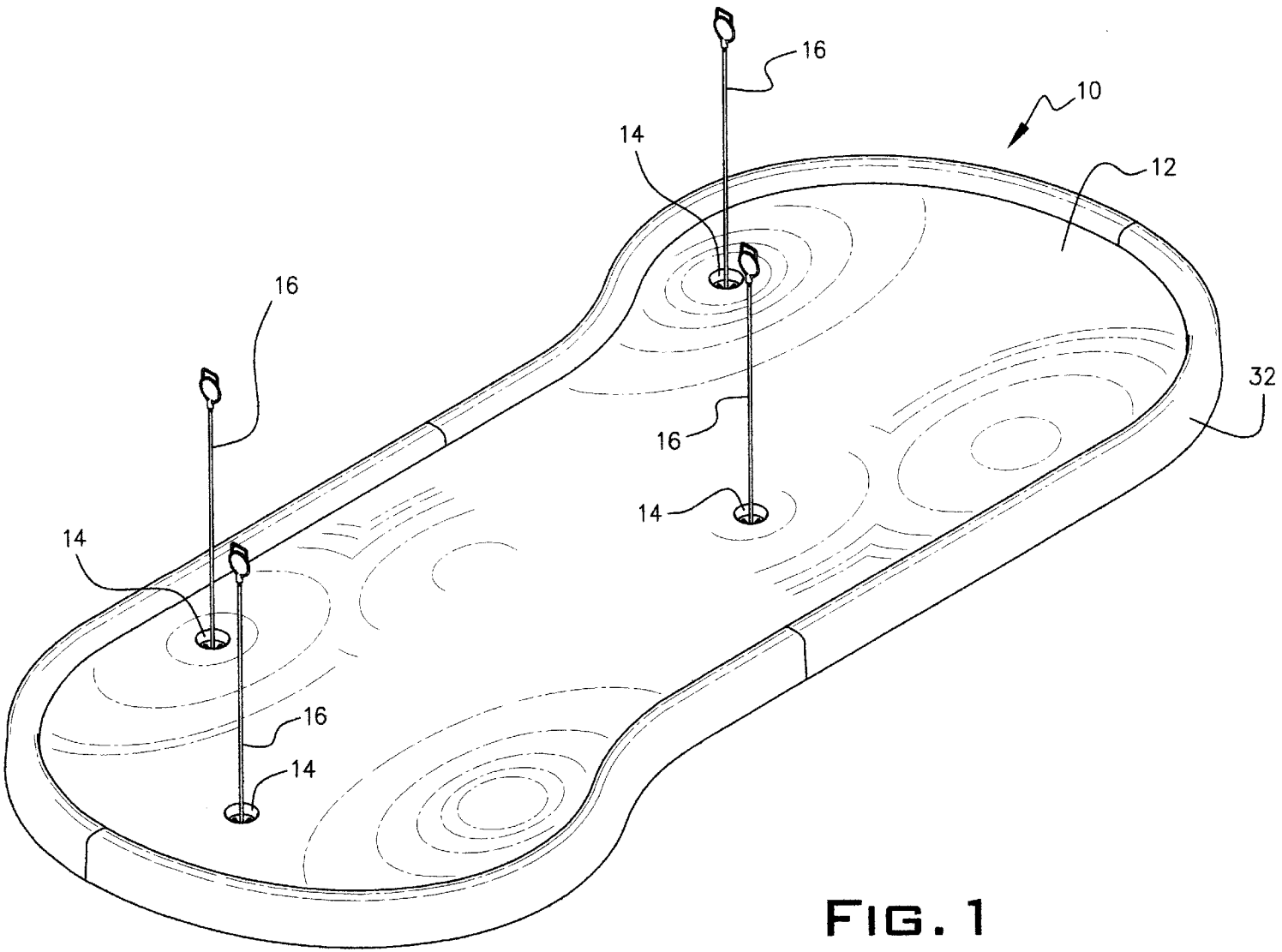
FIG. 1 is a top perspective view of the portable golf putting green of this invention.

Throughout the following detailed description, the same reference numerals refer to the same elements in all figures.

Figure 2:
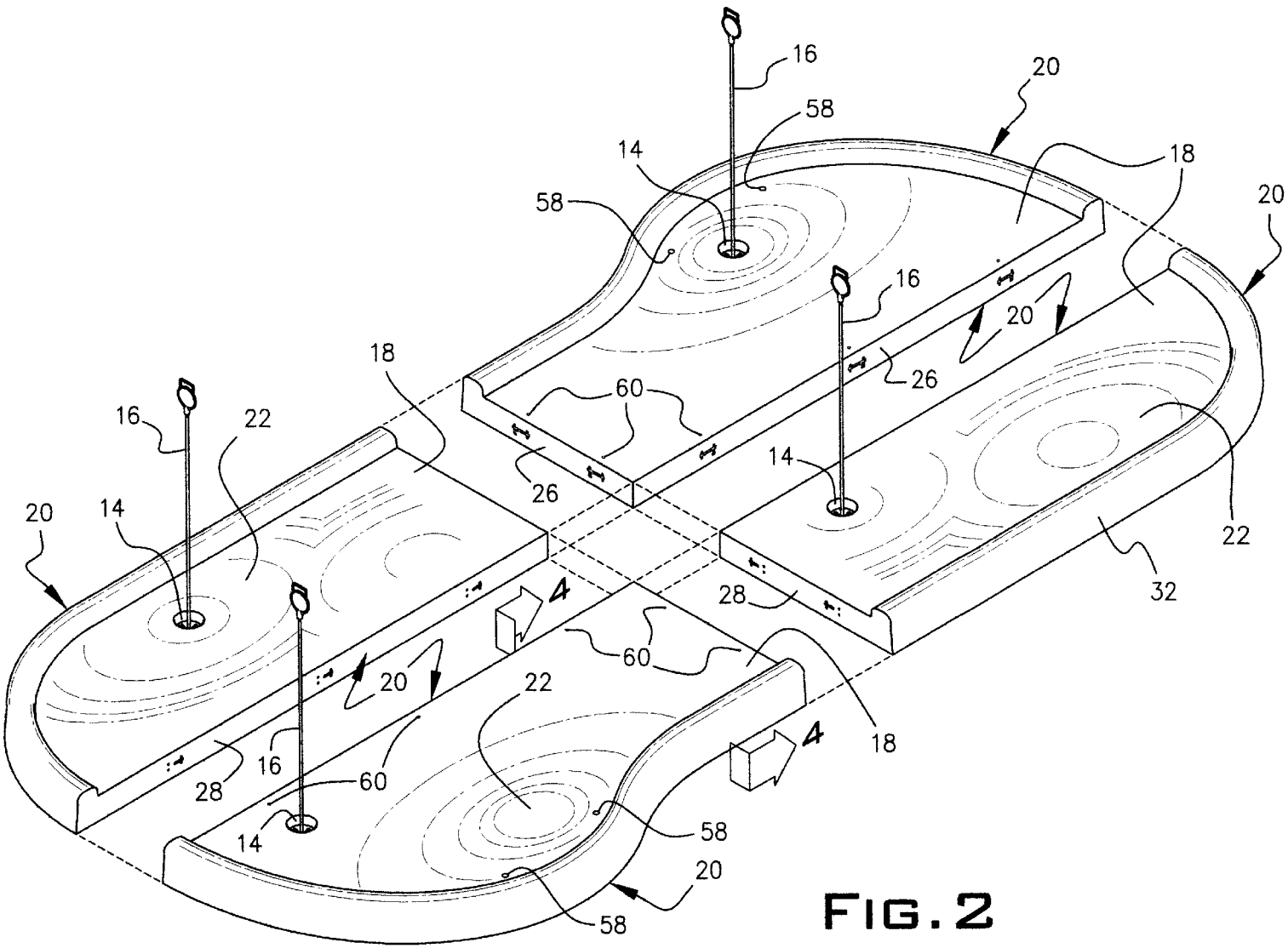
FIG. 2 is a pulled apart view of four polymeric units, which when joined form the surface area for covering with a simulated grass.

Referring to FIG. 1, the golf putting training green 10 of this invention has a top surface of simulated grass 12 which can be a synthetic turf or close cropped rug. Multiple golf ball cups 14, each containing a ball retrieve device 16 are placed in receptacles 62 in a polymeric unit 20. As seen in FIG. 2, the top surface 18 of each polymeric unit 20 is contoured 22 to provide a surface similar to one found on an actual golf course green. Such contour 22 promotes skill in approaching golf cups 14 that are guarded by undulating greens. Raised rolled edges 32 prevent a golf ball from leaving the green.

Figure 3:
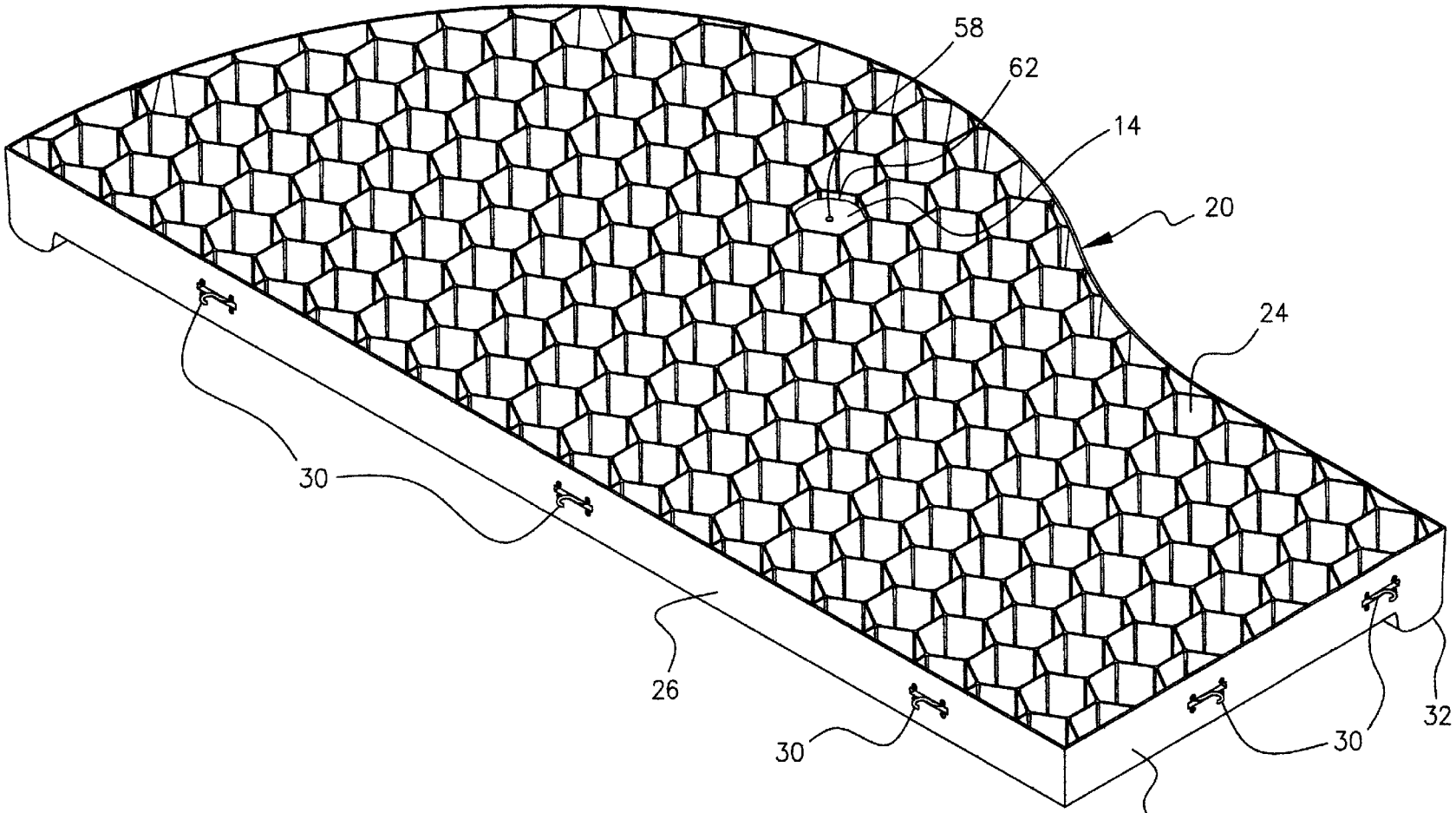
FIG. 3 is a bottom perspective view of a molded polymetric unit of this invention.
Figure 4:
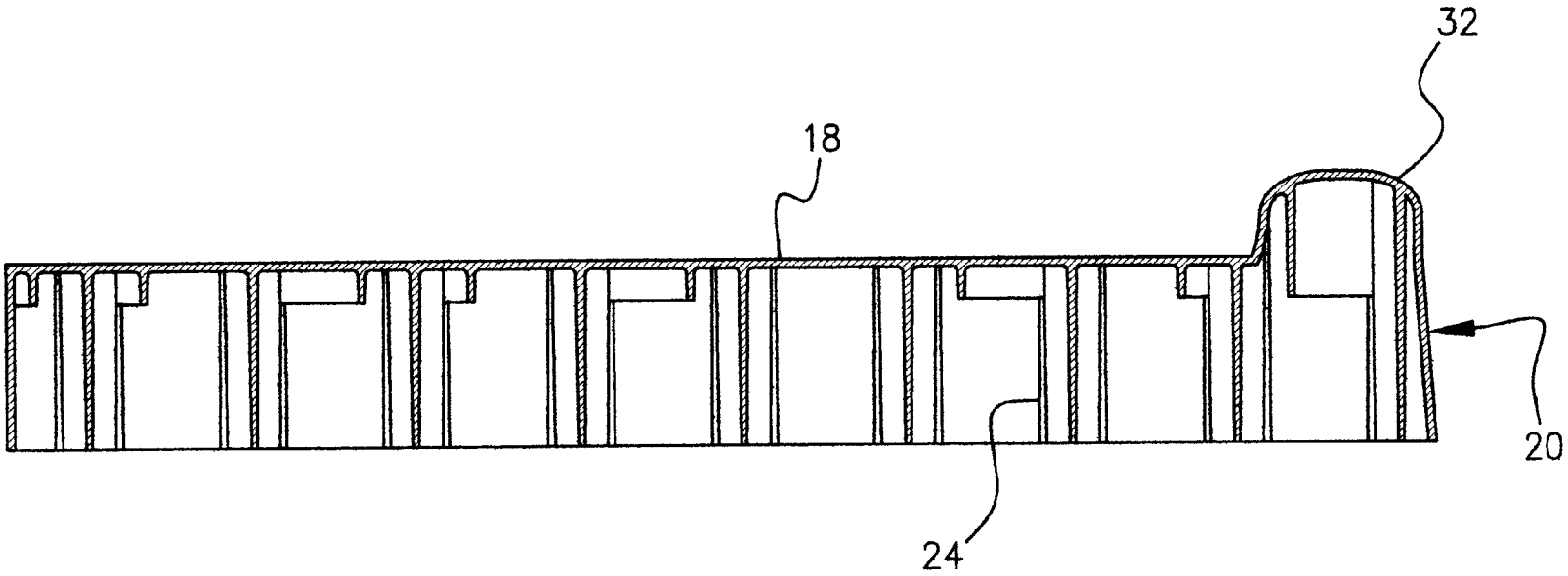
FIG. 4 is a side sectional view in elevation along line 44 of FIG. 2.
Figure 8:
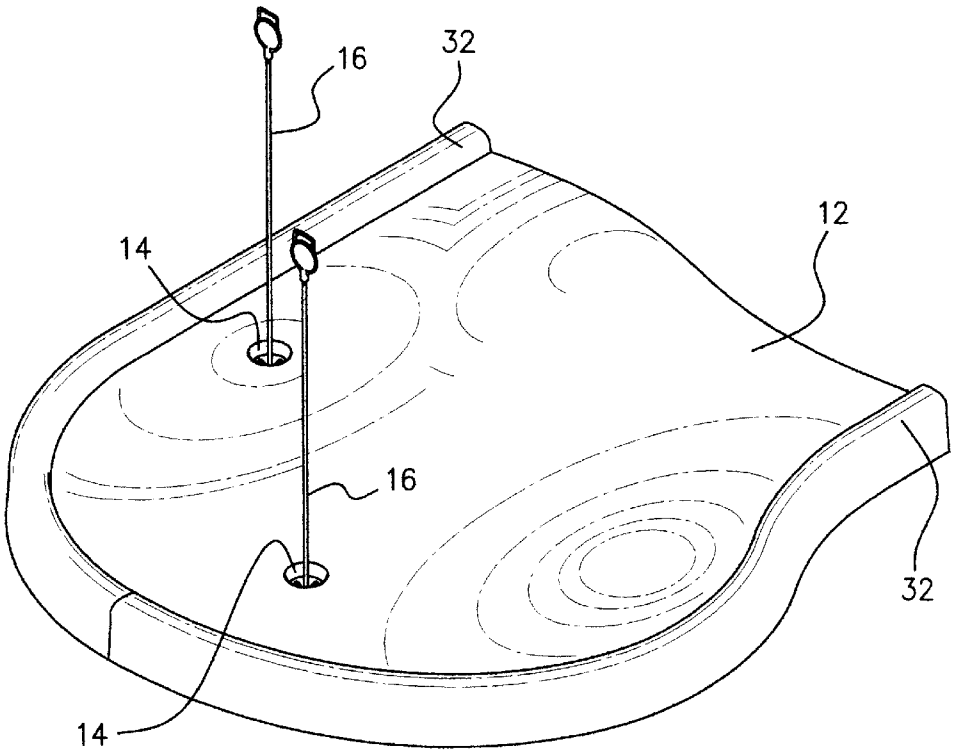
FIG. 8 is a cut away portion of the golf putting surface with a chipping platform positioned for chipping onto the putting surface.
Figure 8:
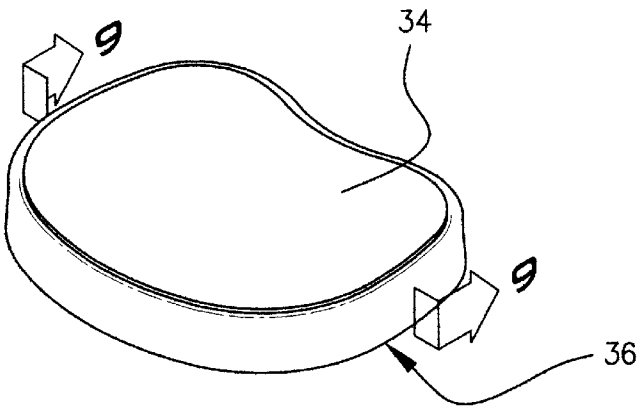
Figure 9:
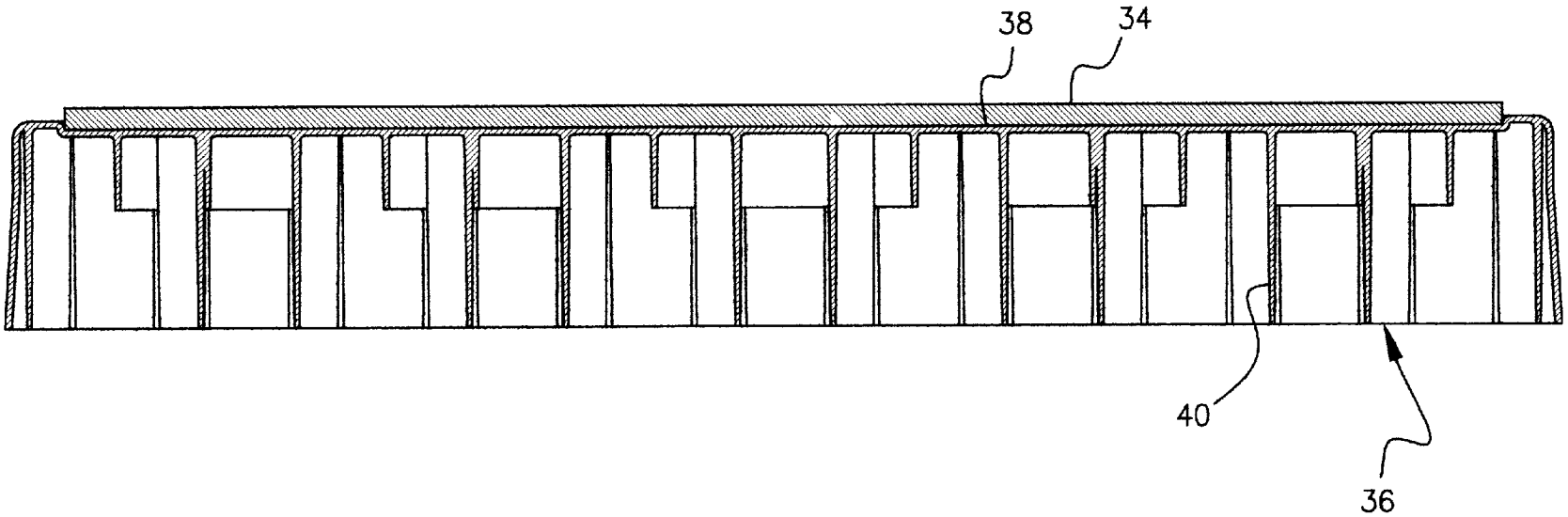
FIG. 9 is a sectional view in elevation of the chipping platform of FIG. 8 along line 9—9.

As seen in FIG. 3, each polymeric unit 20 is compression molded, blow molded or injection molded with a grid structure on a bottom portion integral with a smooth top surface 18. Side portions 26 and 28 of each polymeric unit 20 contain latching features 30. Other types of molding of the polymeric unit 20 that can be used include low pressure flow molding, rotational molding, structural foam injection molding and reaction injection molding. Synthetic turf or carpet can be used for the simulated grass top surface 12 of the putting training green 10 and is laid point to point at the base of the rolled edges 32 as seen in FIG. 1. A thicker rug carpet 34 is used on the chipping platform 36 shown in FIGS. 8 and 9 to simulate a typical chipping surface. The chipping platform 36 is molded in the same manner as the polymeric unit 20 and has a smooth top surface 38 integral with a grid structure 40.

Two or more polymeric units are latched together to make the multiple molded polymeric units forming the platform surface. Four polymeric units are preferred but fewer or more can be provided, depending on the desired size of the platform.

The polymer employed in the molding and creation of the polymeric unit 20 or the chipping platform 36 can be any of the high strength polymers such as polyethylene, polypropylene and co-polymers thereof and structural foams such as made from polyurethane.

Figure 6:
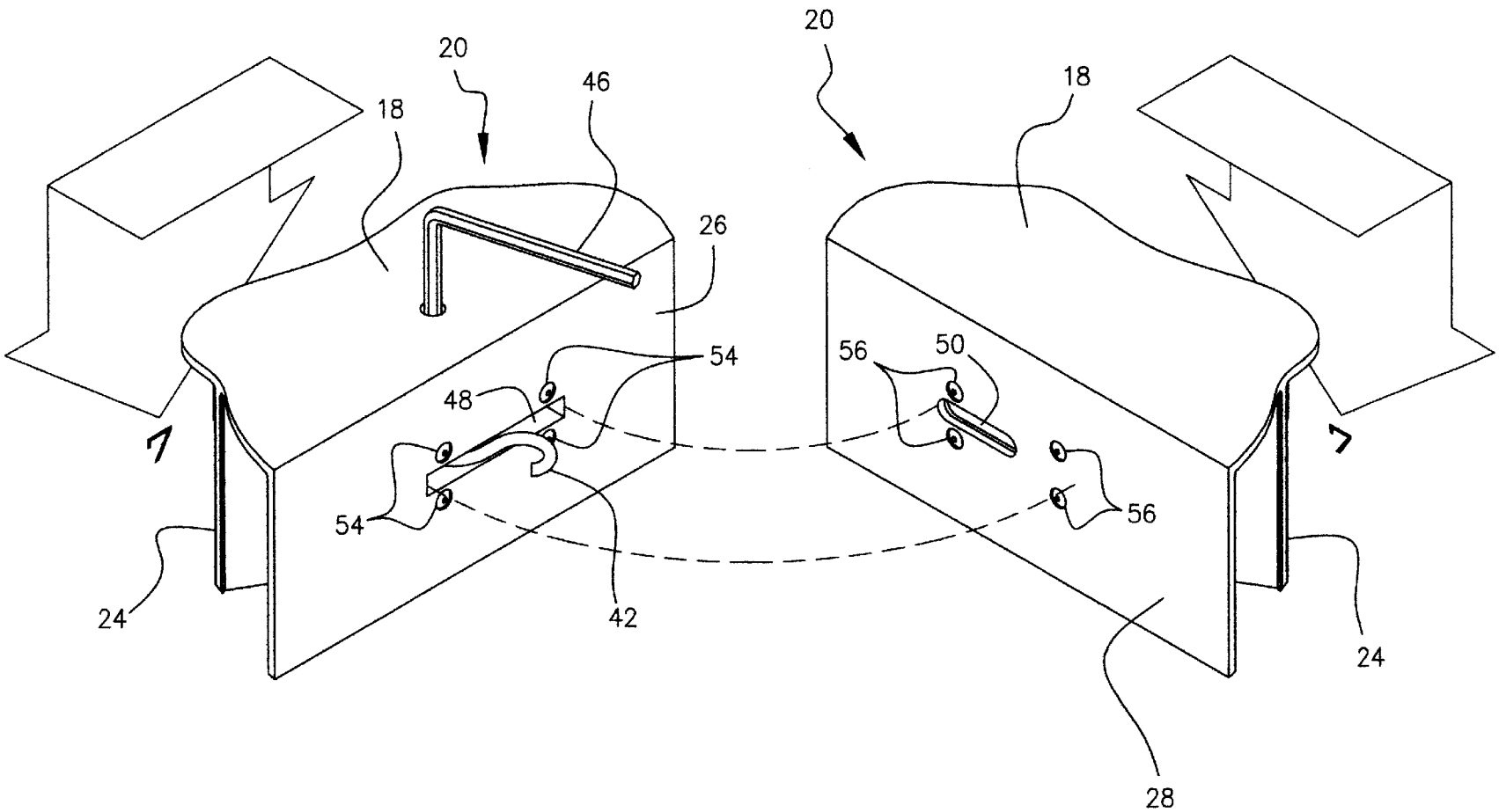
FIG. 6 is a magnified view of a locking mechanism engaging sides of two cut away adjacent polymeric units.
Figure 7:
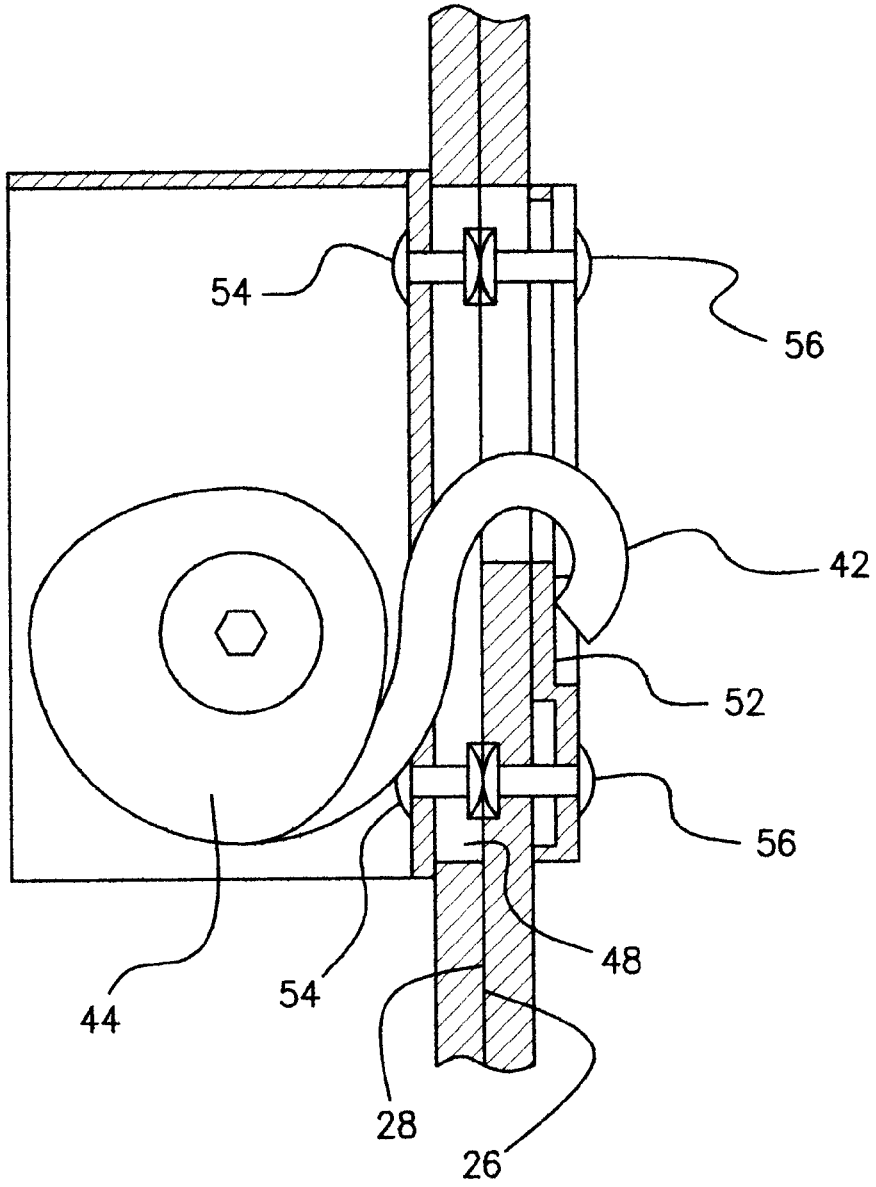
FIG. 7 is a sectional view of the locking mechanism along line 7—7 of FIG. 6.

The latching mechanism 30 shown in FIGS. 6 and 7 has an S-LARGO, hook 42 attached to a cam 44 that is turned by an allen wrench 46. The S-hook 42 protrudes from a slot 48 on a side surface 26. The S-hook 42 is inserted into slot 50 on side surface 28 and engages a plate 52 to hold the adjacent polymeric units 20 together. Rivets 54 hold the cam 44 in position in relation to side wall 26 and rivets 56 hold the plate 52 to side wall 28.

Figure 5:
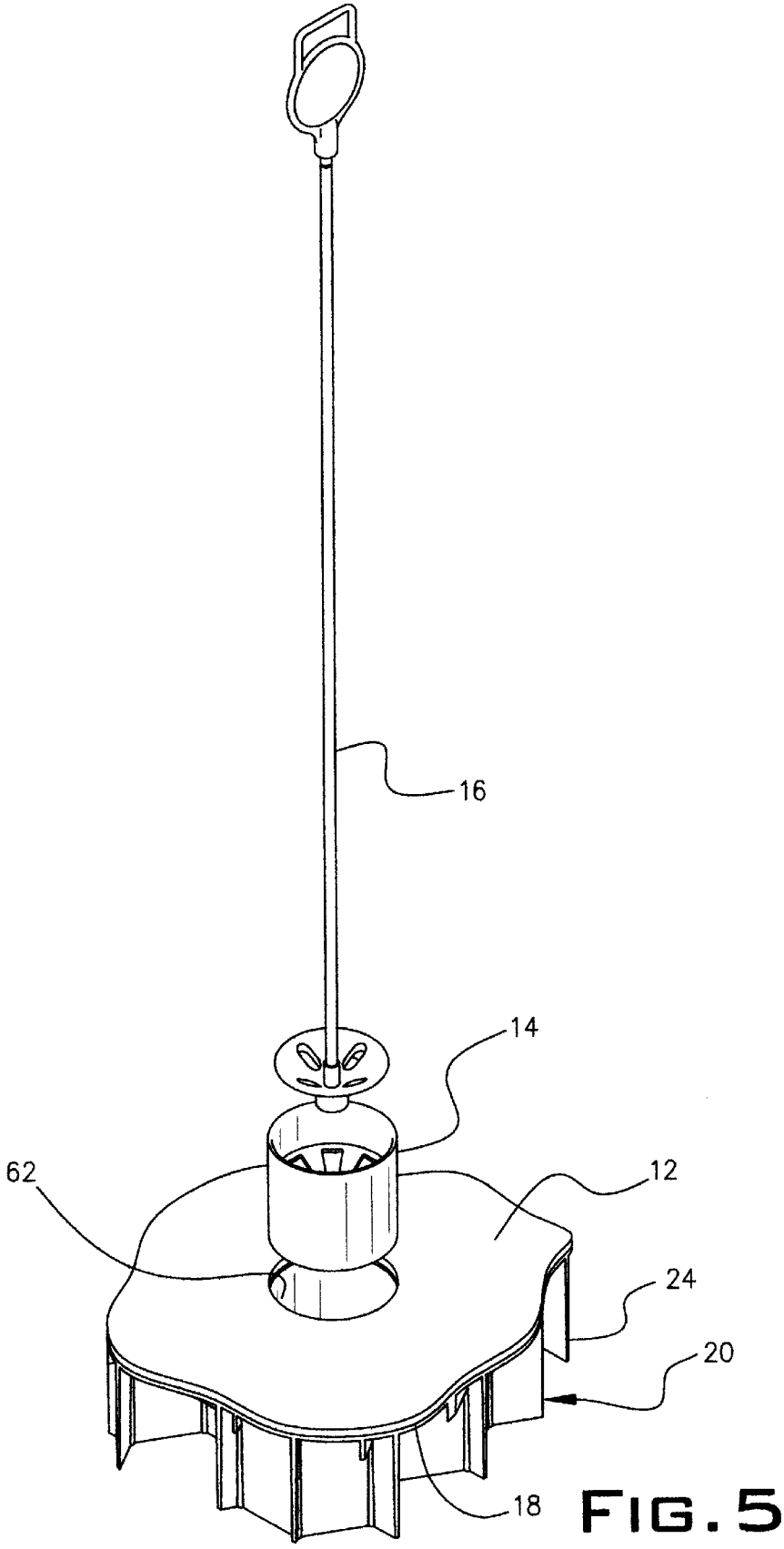
FIG. 5 is a perspective view of a portion of a polymeric unit with overlying simulated grass having a golf ball cup being inserted into a receptacle in the polymeric unit.

Drain holes 58 for water are positioned at low spots on the top surface and in the golf ball cup 14. Holes 60 for insertion of the allen wrench 46 are located above the slots in the polymeric unit containing an S-hook 42 in a side wall 28. A receptacle 62 in a polymeric unit 20 is used to insert a golf ball cup 14 as seen in FIG. 5.

The portable golf putting training aid 10 will preferably be six inches high at the top of the raised rolled edge 32. The pitch or contour 22 on the top surface 18 will be from one-sixteenth inch to one inch and the receptacle 62 will have a diameter of about four inches for receipt of the golf ball cup 14.

The simulated grass 12 can be a carpet with a closely cropped fiber that is dye cut or water jet cut. Alternatively, synthetic turf such as used on golf practice facilities can be employed as simulated grass 12.

The chipping platform 36 should have longer fiber 34 covering the top surface 38 to more closely simulate a natural chipping surface.

Although the grid structure 24 is shown as a six sided structure or hexagon, it can take the form of any shaped grid structure capable of supporting about three hundred pounds.

The above description has described specific structural details employing the invention. However, it will be within one having skill in the art to make modifications without departing from the spirit and scope of the underlying inventive concept of this portable golf putting training green. The invention is not limited to the structure described but includes such modifications as are substantially equivalent to the elements of the golf putting training green.

Having thus described the invention, what is claimed and desired to be secured by Letters Patent is:

1. A portable golf putting training green comprising multiple molded polymeric units joined together, each polymeric unit molded as an integral rigid body having a smooth top surface and an open at a bottom surface grid structure supporting the top surface, each polymeric unit having a first and a second side wall containing slots for positioning a fastening mechanism and another side wall joining the first and second side walls consisting of a raised edge higher than the smooth top surface;

a simulated grass layer covering the smooth top surface; and a receptacle molded in the polymeric unit adapted to receive a golf ball cup in at least one of the polymeric units.

2. The portable golf putting training green according to claim 1 wherein the top surface is contoured to simulate a rolling putting green surface.

3. The portable golf putting training green according to claim 1 wherein a water drain hole passes through the polymeric unit.

4. The portable golf putting training green according to claim 1 wherein a chipping platform comprising a polymeric unit having a smooth planar top surface integral with a supporting grid and a layer of simulated grass over the smooth planar top surface is spaced apart from the portable golf putting training green.

5. The portable golf putting training green according to claim 1 wherein the fastening mechanism is a cam operated S-hook within the first and second side walls of one polymeric unit engaging a complimentary plate in the first and second side walls of an adjacent polymeric unit, the cam adapted to be turned by an allen wrench.

6. The portable golf putting training green according to claim 1 wherein the polymeric units are made by a blow molding process.

7. The portable golf putting training green according to claim 1 wherein the polymeric units are made by an injection molding process.

8. The portable golf putting training green according to claim 1 wherein the polymeric units are made by a compression molding process.

9. The portable golf putting training green according to claim 1 wherein the grid structure consists of multiple joined six sided elements open at a bottom and closed at a top by the smooth top surface.

10. A portable golf putting training green comprising:

a first molded rigid integral polymeric structure having a smooth top surface and a grid like bottom surface fastened to an adjacent second molded rigid integral polymeric structure having a smooth top surface and an open grid like bottom surface, at least one receptacle in the polymeric structure from a top to a bottom portion adapted to receive a golf ball cup and at least one hole through the polymeric structure configured from a top to a bottom adapted to drain water from the top surface;

a side surface of the first and second polymeric structure having complimentary slots for receipt of fastening mechanisms;

a simulated grass layer covering the smooth top surface of the first and second joined polymeric structure and having a complementary hole for receipt of a golf ball cup; and a raised edge higher than the smooth top surface along a portion of the first and second polymeric structures.

11. The portable golf putting training green according to claim 10 wherein the smooth top surface is contoured to simulate a natural putting green surface.

12. The portable golf putting training green according to claim 10 wherein the grid like bottom surface is in the shape of multiple joined hexagons.

13. The portable golf putting training green according to claim 10 wherein the simulated grass layer is a close cropped multi-fiber rug.

14. The portable golf putting training green according to claim 10 wherein the simulated grass layer is synthetic turf.

15. The portable golf putting training green according to claim 1 wherein there are four polymeric units joined together and covered with simulated grass.

16. The portable golf putting training green according to claim 15 wherein the simulated grass is synthetic turf.

17. The portable golf putting training green according to claim 15 wherein the simulated grass is a closely cropped rug.

18. The portable golf putting training green according to claim 1 wherein the polymeric units are made by a low pressure blow molding process.

19. The portable golf putting training green according to claim 1 wherein the polymeric units are made by rotational molding.

20. The portable golf putting training green according to claim 1 wherein the polymeric units are made by structural foam injection molding.

21. The portable golf putting training green according to claim 1 wherein the polymeric units are made by reaction injection molding.

* * * * *